United States Patent [19]

Davis, Jr.

[11] 4,060,458

[45] Nov. 29, 1977

[54] SEPARATION OF GAS FROM SOLIDS

[75] Inventor: Rufus F. Davis, Jr., Russell, Ky.

[73] Assignee: Coaltek Associates, Morris Township, N.J.

[21] Appl. No.: 643,964

[22] Filed: Dec. 24, 1975

[51] Int. Cl.[2] ..... C10B 31/04

[52] U.S. Cl. ..... 201/40; 202/262; 214/18 R; 302/28; 302/59

[58] Field of Search ..... 201/28, 31, 36–38, 201/40, 41; 202/117, 262, 263; 214/16 R, 18 R, 17 C; 302/21, 28, 24, 25, 32, 59

[56] References Cited

U.S. PATENT DOCUMENTS

| | | | |
|---|---|---|---|
| 3,432,398 | 3/1969 | Schmidt | 201/38 |
| 3,457,141 | 7/1969 | Schmidt | 201/38 X |
| 3,523,065 | 8/1970 | Schmidt | 201/40 |
| 3,537,755 | 11/1970 | Schmidt | 302/59 X |
| 3,761,360 | 9/1973 | Auvil et al. | 201/40 |
| 3,884,620 | 5/1975 | Rammler | 201/31 X |

*Primary Examiner*—Morris O. Wolk

*Assistant Examiner*—Michael S. Marcus

*Attorney, Agent, or Firm*—Gerard P. Rooney

[57] ABSTRACT

Method and apparatus for use in a system which conducts a mixture of granular solids, such as preheated coal particles, and carrier gas, such as steam, to a plurality of enclosures, such as individual coke ovens of a coke oven battery. The mixture passes through a primary conduit and at least a portion of the mixture is diverted from the primary conduit by diverter means to a plurality of branch conduits. Each of the branch conduits leads to one of the enclosures. The method includes: removing a portion of the carrier gas from the mixture in the branch conduit prior to introducing the granular solids into the enclosure; and returning the removed portion of the carrier gas to the primary conduit downstream of the diverter means. The apparatus of the present invention includes a bleed-off conduit arranged between each of the branch conduits and a portion of the primary conduit downstream of the diverter means.

4 Claims, 2 Drawing Figures

SEPARATION OF GAS FROM SOLIDS

BACKGROUND OF THE INVENTION

The present invention relates to a method and apparatus for separating gas from solids. More particularly, the present invention relates to a method and apparatus for conducting a mixture of granular solids and carrier gas to a plurality of enclosures by passing the mixture through a primary conduit, diverting at least a portion of the mixture from the primary conduit by a diverter means to a plurality of branch conduits, and removing a portion of the carrier gas from the mixture in the secondary conduit prior to introducing the granular particles into the enclosure.

One use of the present invention is in a coke plant wherein a pipeline charging system charges a plurality of coke ovens with coal by conducting a mixture of preheated coal particles and carrier gas through a primary pipeline to a battery of coke ovens. At least a portion of the mixture of coal and carrier gas is diverted from the primary pipeline into a plurality of branch pipelines. The present invention removes a portion of the carrier gas from the mixture in the branch pipeline prior to introducing the mixture into the coke oven.

The present invention is an improvement of a method and apparatus disclosed in U.S. Pat. No. 3,761,360 to H. S. Auvil et. al. entitled "Re-entrainment Charging of Preheated Coal Into Coke Oven Chambers of a Coke Oven Battery," issued Sept. 25, 1973. An earlier improvement of the apparatus and method disclosed in U.S. Pat. No. 3,761,360 uses a separate header pipeline to conduct carrier gas, such as steam, to a condenser tank and requires an additional amount of carrier gas, typically an additional twenty pounds of steam per minute, as compared to the amount of carrier gas required in a system which uses the present invention. German Pat. No. 598,363 to Schmidt (1934) entitled "Process for the Reduction of Wear of two Conveyors of Pneumatic or Hydraulic Conveyor Systems" discloses a process for reduction of wear in a pipe conveyor.

SUMMARY OF THE INVENTION

It is an object of the present invention to eliminate a need for an auxiliary conduit, such as a separate header pipeline, to convey carrier gas removed from a mixture of granular solids and carrier gas in a branch conduit of a system which conducts such a mixture. It is another objective of the present invention to reduce the consumption of carrier gas in such a system.

The method and apparatus of the present invention are adapted for use in a system which conducts a mixture of granular solids and carrier gas to a plurality of enclosures. The mixture passes through a primary conduit and at least a portion of the mixture is diverted from the primary conduit by diverter means to a plurality of branch conduits. Each of the branch conduits leads to one of the enclosures. The method of the present invention is an improvement which includes: removing a portion of the carrier gas from the mixture in the branch conduit prior to introducing the granular solids into the enclosure; and returning the removed portion of the carrier gas to the primary conduit downstream of the diverter means for the respective branch conduit. The apparatus of the present invention is an improvement which includes: a bleed-off conduit arranged between each of the branch conduits and a portion of the primary conduit downstream of the diverter means for the respective branch conduit.

DESCRIPTION OF THE PREFERRED EMBODIMENT

A preferred embodiment of the present invention is used in a coke plant for the conversion of coal to coke. The invention is an improvement in a method and apparatus for conducting a mixture of preheated comminuted coal particules and carrier gas through a primary pipeline to a plurality of coke ovens. At least a portion of the mixture is selectively diverted from the primary conduit by a plurality of diverter means to a plurality of branch pipelines. Each branch pipeline leads to individual coke oven of a coke oven battery. Such an arrangement of a primary pipeline and branch pipelines, without the improvements of the present invention, for charging coke ovens is illustrated in U.S. Pat. No. 3,761,360 to H. S. Auvil et al. Additional description relating to a pipeline charging system for charging coke ovens of a coke oven battery by conducting a mixture of preheated comminuted coal and carrier gas through a pipeline is contained in the following U.S. Pat. Nos. to L. D. Schmidt: 3,047,473; 3,374,151; 3,432,398; 3,457,141; 3,537,755 and 3,523,065.

Figure 2:
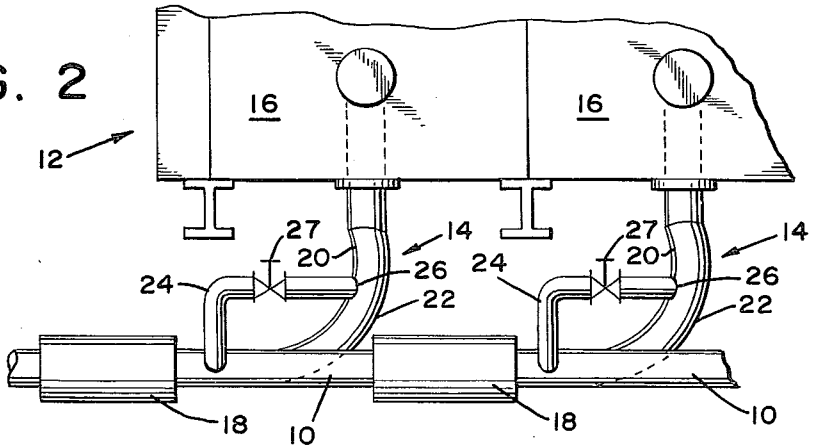
FIG. 2 is a fragmentary top plan view of the coke oven battery, primary pipeline and branch pipelines of FIG. 1.
Figure 1:
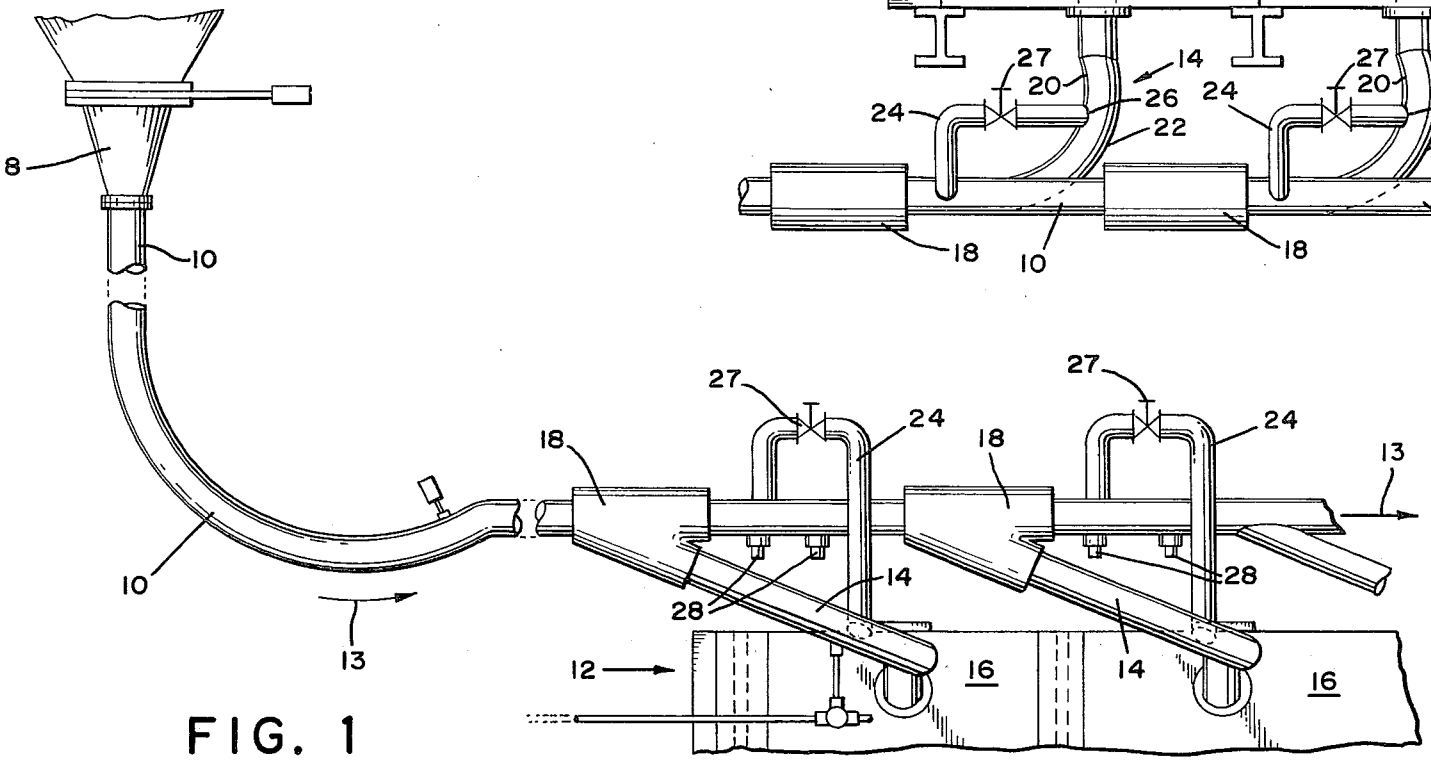
FIG. 1 is a fragmentary front elevational view of a coke oven battery showing a primary pipeline and a plurality of branch pipelines leading to individual coke ovens of the coke oven battery.

Referring to FIGS. 1 and 2, coal which is coarsely comminuted and preheated is mixed with a carrier gas, such as steam. The mixture of coal and gas is passed through a funnel shaped accelerator 8. The accelerator 8 communicates with an end of a primary pipeline 10 which extends along and parallel with the length of a coke oven battery 12 at one side thereof. The mixture of coal and gas moves through the primary pipeline 10 in a direction indicted by arrow 13. Branch pipelines 14, sometimes known as "sweeps, " lead from the primary pipeline 10 to each coke oven 16 of the battery 12. Diverter valves 18 are arranged in series along the primary pipeline 10. There is one diverter valve 18 provided for each branch pipeline 14. The function of the diverter valves 18 is to control the flow of the mixture of coal and carrier gas. The diverter valves 18 may be arranged to cause at least a portion of the mixture of coal and carrier gas to pass from the primary pipeline 10 to a branch pipeline 14 connected to the respective diverter valve 18, and then to the respective coke oven 16. Referring to FIG. 2, each of the branch pipelines 14 has a curved shape, an inner curved side 20 and an outer curved side 22.

The method of the present invention includes: removing at least a portion of the carrier gas from the mixture of coal and carrier gas in the branch pipeline 14 immediately prior to introducing the mixture into the respective coke oven 18 for that branch pipeline 14; and returning the removed portion of the carrier gas from the branch pipeline 14 to the primary pipeline 10 at a point in primary pipeline downstream of the respective diverter valve 18 for that branch pipeline 14. Such removal is sometimes referred to as "bleed-off." The method further includes removing at least a portion of the carrier gas from the inner curved side 20 of the branch pipeline 14. It has been found by experience that the mixture of carrier gas and of coal passing through the branch pipeline 14 is such that the coal particles tend to move adjacent to the outer curved side 22, while the carrier gas tends to move adjacent to inner curved side 20. As a result, romoval of carrier gas from the inner curved side 20 is more effective than removal from the outer curved side 22.

The apparatus of the present invention includes a bleed-off off pipeline 24 arranged between each of the branch pipelines 14 and a portion of the primary pipeline 10 downstream of the respective diverter valve 18 for that branch pipeline 14. The bleed-off pipeline 24 is connected to the inner curved side 20 of the branch pipeline 14 at a bleed-off point 26. A valve 27 is provided in each bleed-off pipeline 24.

For example, the mixture of coal and steam flowing down through the primary pipeline 10 may consist of 6,000 pounds of coal per minute and 50 pounds of steam per minute. At the bleed-off point 26, 25 pounds of steam per minute are bled-off, so that the mixture fed into coke oven consists of 6,000 pounds of coal per minute and 25 pounds of steam per minute. The 25 pounds of steam per minute which has been bled-off is fed back into the primary pipeline 10 downstream of the respective diverter valve 18 for that branch pipeline 14. In practice, it has been found that about 4 pounds of coal per minute of the 6,000 pounds of coal per minute remain with the 25 pounds of steam per minute which is bled-off and returned to the primary pipeline 10. The primary pipeline may, for example, be a 6-inch or 8-inch pipeline. The bleed-off pipeline 24 may, for example, be a three or four inch pipeline.

The method and apparatus of the present invention accomplishes bleed-off of approximately one-half of the steam which had previously been mixed with the coal flowing through the primary pipeline 10. The remaining steam, not bled-off, flows with the coal into the coke oven 16. The present invention reduces the amount of piping required because it eliminates the need for a separate header pipeline to conduct steam to a condenser tank. As a result, the present invention eliminates the amount of steam required by the separate header pipeline which typically may be 20 pounds per minute. For a system having multiple pipelines, the savings would typically be 20 pounds per minute for each pipeline. The present invention reduces the amount of steam supplied to the coke ovens 16 because there is a lower steam-to-coal ratio in the mixture supplied to each coke oven 16, which facilitates good leveling of the coal in the oven 16. Steam jet plugs 28 are used at various points along the primary pipeline 10 to supply steam to the pipeline 10, but preferably no such steam jet plugs 28 are used in the branch pipelines 14. An additional advantage of the present invention is that, in event that the pipeline charging system becomes plugged in the area of a branch pipeline 14, such plugging will affect only one coke oven 16, not all coke ovens of the coke oven battery 12.

I claim:

1. In a method for charging a plurality of coke oven chambers of a coke oven battery with preheated coal particles by conveying a mixture of said coal particles and a carrier gas through a primary pipeline which communicates with each of the coke oven chambers of said battery through a plurality of branch pipelines, passing at least a portion of said mixture from said primary pipeline into a branch pipeline communicating with a coke oven chamber to be charged while the remaining portion of said mixture continues to be conveyed in said primary pipeline downstream from said branch pipeline, and removing a portion of said carrier gas from said mixture in said branch pipeline prior to introducing said mixture into said coke oven chamber to be charged by said branch pipeline; the improvement comprising reintroducing the carrier gas removed from said branch pipeline into the primary pipeline conveying the remaining portion of said mixture at a point downstream from where that portion of said mixture in the primary pipeline was passed into said branch pipeline.

2. The method of claim 1 wherein the carrier gas removed from the branch pipeline contains minor amounts of coal particles.

3. In an apparatus for charging a plurality of coke oven chambers of a coke oven battery with preheated coal particles contained in a mixture of said coal particles and a carrier gas comprising a primary pipeline communicating at one of its ends with a source of said mixture and on the other end said coke oven chambers through a plurality of branch pipelines, each of which communicates with a coke oven chamber, diverting means in said primary pipeline for diverting at least a portion of said mixture from said primary pipeline to a branch pipeline and means in said branch pipeline for removing from said branch pipeline a portion of the carrier gas from said mixture prior to introducing said mixture into a coke oven chamber; the improvement wherein said means for removing a portion of carrier gas from said branch pipeline comprises a bleed-off pipeline connected at one of its ends to said branch pipe line and connected at its other end to said primary pipeline downstream of said diverter means for said branch pipeline.

4. The apparatus of claim 3 wherein the branch pipeline has a curved shape comprising an inner curved side and an outer curved side and the bleed-off pipeline is connected at one of its ends to said inner curved side of said branch pipeline.

* * * * *